US008148883B2

(12) United States Patent
Honda et al.

(10) Patent No.: US 8,148,883 B2
(45) Date of Patent: Apr. 3, 2012

(54) SPARK PLUG USED FOR AN INTERNAL-COMBUSTION ENGINE AND A METHOD FOR MANUFACTURING THE SAME

(75) Inventors: Toshitaka Honda, Iwakura (JP); Hiroyuki Tanabe, Nagoya (JP); Takamitu Mizuno, Hasima (JP); Hiromi Otuka, Konan (JP)

(73) Assignee: NGK Spark Plug Co., Ltd., Nagoya-Shi, Aichi-Ken (JP)

( * ) Notice: Subject to any disclaimer, the term of this patent is extended or adjusted under 35 U.S.C. 154(b) by 825 days.

(21) Appl. No.: 11/683,113

(22) Filed: Mar. 7, 2007

(65) Prior Publication Data

US 2007/0228915 A1 Oct. 4, 2007

(30) Foreign Application Priority Data

Mar. 16, 2006 (JP) ..... 2006-072708

(51) Int. Cl.
*H01T 13/00* (2006.01)
*H01T 13/20* (2006.01)

(52) U.S. Cl. ..... 313/141; 313/118; 313/143; 313/144; 313/142

(58) Field of Classification Search ..... None
See application file for complete search history.

(56) References Cited

U.S. PATENT DOCUMENTS 6,407,487 B1 * 6/2002 Sugimoto ..... 313/141
6,632,381 B2 * 10/2003 Sugimoto ..... 264/12

FOREIGN PATENT DOCUMENTS

| | | |
|---|---|---|
| JP | 11-43368 | 2/1999 |
| JP | 2000-247729 | 9/2000 |
| JP | 2001-48637 | 2/2001 |
| JP | A-2001-089246 | 4/2001 |
| JP | A-2002-305069 | 10/2002 |
| JP | 2003-303661 | 10/2003 |

OTHER PUBLICATIONS

Japanese Office Action issued Aug. 6, 2010 for the corresponding Japanese Patent Application No. 2006-072708.

* cited by examiner

*Primary Examiner* — Niemeshkumar D. Patel
*Assistant Examiner* — Natalie K Walford
(74) *Attorney, Agent, or Firm* — Leason Ellis LLP.

(57) ABSTRACT

The present invention provides a highly reliable spark plug used for an internal-combustion engine and including an insulator with a high withstand voltage, and a method for manufacturing the same. Namely, it provides a spark plug containing a cylindrical metal shell having an insulator holding hole, a cylindrical insulator including an axial hole therein which extends in an axial direction, and engaging with said insulator holding hole of said metal shell, and a center electrode held in said axial hole of said insulator, wherein said insulator has a texture in which one or more pores exposed in a judgment area with 50 μm in diameter occupy 40% or less of said judgment area at any locations in an observation area, in the case where a predetermined mirror-finishing section of an enclosed portion surrounded by said metal shell is used as said observation area to observe pores exposed in said observation.

2 Claims, 13 Drawing Sheets

SPARK PLUG USED FOR AN INTERNAL-COMBUSTION ENGINE AND A METHOD FOR MANUFACTURING THE SAME

FIELD OF THE INVENTION

The present invention relates to a spark plug used for an internal-combustion engine, and a method for manufacturing the same.

BACKGROUND OF THE INVENTION

In a spark plug used for igniting an internal-combustion engine, such as a gasoline engine for an automobile, the construction of an engine head has been sophisticated according to an advance of an engine in the recent years. Further, a miniaturization of a spark plug and a reduction in the diameter thereof are in demand due to a reduction in a mounting space of a spark plug. In order to miniaturize and reduce the diameter of a spark plug, the diameter of a metal shell having a mounting portion being fixed to the engine head is reduced, and the thickness of an insulator held inside the metal shell needs to be thinned as well as the diameter of the insulator reduced.

However, when the insulator is made thin and the diameter thereof reduced, a tendency of causing a dielectric breakdown generated between the metal shell enclosing the circumference of the insulator and a center electrode inserted in an axial hole through penetrating the insulator may increase. Further, it is difficult to secure the withstand voltage. In order to meet these conflicting demands, the withstand voltage of the insulator is desired to be high.

As a concrete means to solve the above-mentioned problems, for example, Japanese Patent Application Laid-Open (kokai) No. H9-272273 discloses an alumina ceramic having a pore rate of 0.5% or less. Further, Japanese Patent Application Laid-Open (kokai) No. H11-45143 discloses an alumina-based sintered body having pores which are exposed on a predetermined mirror-finishing face, occupying 4% orless of the mirror-finishing face and having a maximum length of 15 μm or less.

SUMMARY OF THE INVENTION

However, according to an investigation conducted by the inventors of the present invention, it was observed that a dielectric breakdown of an insulator was likely to occur not only in the case where any giant pore or a pore having a maximum major axis of 15 μm or more was present, but also likely to occur in the case where each pore was small, and a plurality of pores was densely present, which was likely to serve as a starting point of the dielectric breakdown. That is, although such dense pores are allowed in a prior art, in fact, such dense pores are not preferable when the insulator is made thin and the diameter thereof is reduced.

Therefore, the present invention has been accomplished in view of the above problems, and an object of the invention is to provide a highly reliable spark plug used for an internal-combustion engine and including an insulator with a high withstand voltage, and to provide a method for manufacturing the same.

A means for solving the above problems is a spark plug (hereinafter also referred to as a "plug") used for an internal-combustion engine, containing: a cylindrical metal shell having an insulator holding hole; a cylindrical insulator including an axial hole therein, which extends in an axial direction, and engaging with said insulator holding hole of said metal shell; a center electrode held in said axial hole of said insulator, wherein said insulator has a texture or surface structure in which one or more pores exposed in a judgment area with 50 μm in diameter occupy 40% or less of said judgment area at any locations in an observation area, in the case where a predetermined mirror-finishing section of an enclosed portion surrounded by the metal shell is used as said observation area to observe pores exposed in said observation area.

In the observation area, when an isolated pore is contained in the judgment area of 50 μm in diameter of the insulator and occupies over 40% of the judgment area, a giant pore with a large diameter may be present. Also, when a plurality of pores is contained in the judgment area of 50 μm in diameter and occupies over 40% of the judgment area, a pore group (hereinafter referred to as an "aggregate pore group"), where a plurality of pores is concentrated, may be present.

In the case where the giant pore is present in the insulator, a dielectric breakdown, which penetrates the insulator and starts from a location where the giant pore is present, tends to occur when a high voltage for electric discharge is impressed to a plug or when a high electrical field is impressed to the insulator.

Similarly, in the case where the aggregate pore group is present in the insulator, a dielectric breakdown of the insulator starting from a location where the aggregate pore group is present tends to occur when a high electrical field is impressed to the insulator. The possible reason for this is that the entire aggregate pore group brings about the same effect as that of a giant pore having almost the same size as this pore group.

Therefore, when a diameter or the maximum major axis of a pore is employed as a criterion for judging a quality of withstand voltage of the insulator, the result may not be used to address the actual issues. The reason for this is that when each pore forming the aggregate pore group has a small-sized diameter, it may not be considered as aggregated pores, even if there is a aggregate pore group in the observation area.

On the other hand, the plug according to the present invention uses the insulator having a texture where one or more pores contained in the judgment area of 50 μm in diameter occupy 40% or less of the judgment area at any locations in the observation area when observing the pores in the observation area. That is, the plug according to the present invention uses the insulator containing neither giant pore nor aggregate pore group, which occupies over 40% of the judgment area in at least the enclosed portion. Thus, a dielectric breakdown (penetration destruction), which penetrates the insulator and starts from the location where the giant pore or the aggregate pore group is present, is unlikely to occur, thereby attaining to a reliable plug.

Further, in a spark plug used for an internal-combustion engine as described above, an end of the spark plug to be inserted in an internal-combustion engine is referred to as "front side", and the other end of the spark plug to be located outside of the internal-combustion engine is referred to as "rear side" in said axial direction, wherein said metal shell is composed of: an engaging convex portion projecting radially inwardly and including a rear engaging face, which is located at a rear side of said engaging convex portion; and a front cylindrical portion located at a front side of said engaging convex portion and having a larger inner diameter than that of said engaging convex portion, and wherein said insulator is composed of: a middle trunk portion including an engaging shoulder face located at a front side of said middle trunk portion and engaging with said rear engaging face of said metal shell from a rear side; and a long leg portion located at a front side of said middle trunk portion, having a smaller diameter than that of said middle trunk portion and forming a space with said front cylindrical portion; and wherein, in said insulator, a portion of said long leg portion facing said engaging convex portion has a thickness of 1.80 mm or less in a radial direction perpendicular to said axis.

In this plug, in the long leg portion of the insulator, a portion opposed to the engaging convex portion with regard to the radial direction perpendicular to the axis has a thickness of 1.80 mm or less. In the plug including such a thin insulator, when the insulator includes a giant pore or an aggregate pore group therein, a penetration destruction starting from a location where a giant pore or an aggregate pore group is present tends to occur in the insulator.

Thus, as mentioned above, since the plug contains neither giant pore nor aggregate pore group where one or more pores occupy over 40% of the judgment area, the highly reliable plug including the insulator with high withstand voltage can be attained, despite having a thin insulator.

Furthermore, in the plug, the insulator can maintain insulation without causing any penetration destruction, even though a spark discharge waveform voltage of maximum value of 36 kV is impressed without generating spark discharge between the metal shell and the center electrode.

Further, another means for solving the above problems is a method for manufacturing a spark plug used for an internal-combustion engine which contains a cylindrical metal shell having an insulator holding hole; a cylindrical insulator including an axial hole therein, which extends in an axial direction, and engaging with said insulator holding hole of said metal shell; a center electrode held in said axial hole of said insulator, the method including the following steps: a slurry formation step in which a raw material powder composed mainly of alumina powder and an organic binder are kneaded with a solvent to form slurry; a defoaming step in which thus-formed slurry is disposed under low pressure environment so as to defoam; a granulation step in which thus-defoamed slurry is formed into a granular body; and a press step in which thus-formed granular body is filled in a mold and compressed to form a press-molded body.

The reason why the aggregate pore group is formed in the insulator is that since a void resulting from air bubbles contained in the slurry remains in the granular body, the air bubbles resulting from the void remain in the press-molded body when the granular body is crushed at the press molding step. Thus, the aggregate pore group is likely to remain in the insulator formed by sintering the press-molded body.

On the other hand, in the method for manufacturing the spark plug used for an internal-combustion engine of the present invention, the insulator is formed by the sequential steps of the slurry formation, the defoaming, the granulation and the press step. Thus, since the slurry is defoamed in the defoaming step, the air bubbles contained in the slurry at the kneading process of the slurry formation or the like, can release. Thereby, the void resulting from the air bubbles contained in the slurry is unlikely to remain in the granular body formed at the granulation step. As a result, the air bubbles resulting from the above-mentioned void can be prevented from remaining in the press-molded body when the press-molded body is formed by crushing the granular body in the press step. Further, when the press-molded body is sintered, the aggregate pore group does not remain in the insulator, thereby attaining to the insulator with high withstand voltage and a highly reliable spark plug used for an internal-combustion engine.

In addition, an example of the defoaming step in which the slurry is disposed under low pressure environment includes a vacuum defoaming in which the slurry is placed in a chamber, and the chamber is decompressed by a vacuum pump.

Further, the present invention provides a method for manufacturing the above-mentioned spark plug used for an internal-combustion engine, wherein said alumina powder preferably has an average particle size of 1.0 μm or less.

When the average particle size of alumina powder is small, a surface area of alumina powder relatively increases and an improved sintering can be achieved, thereby attaining to a dense insulator. On the other hand, when the average particle size of alumina powder is 1.0 μm or less, the viscosity of the slurry becomes high, and the air bubbles tends to be encapsulated in the slurry. Therefore, when the average particle size of alumina powder is 1.0 μm or less, the defoaming using the defoaming step is particularly effective to adequately prevent the aggregate pore group from remaining in the insulator formed by sintering the press-molded body.

Further, the present invention provides the method for manufacturing the spark plug used for an internal-combustion engine according to any one of above-mentioned aspects, wherein said slurry preferably contains no agent facilitating a release of the air bubbles.

Unless the slurry contains any agent, such as an antifoaming agent, a dispersant or the like which facilitates a release of the air bubbles, the defoaming step particularly brings about an effect.

DETAILED DESCRIPTION OF THE INVENTION

An embodiment of the present invention will be described with reference to drawings.

Figure 1:
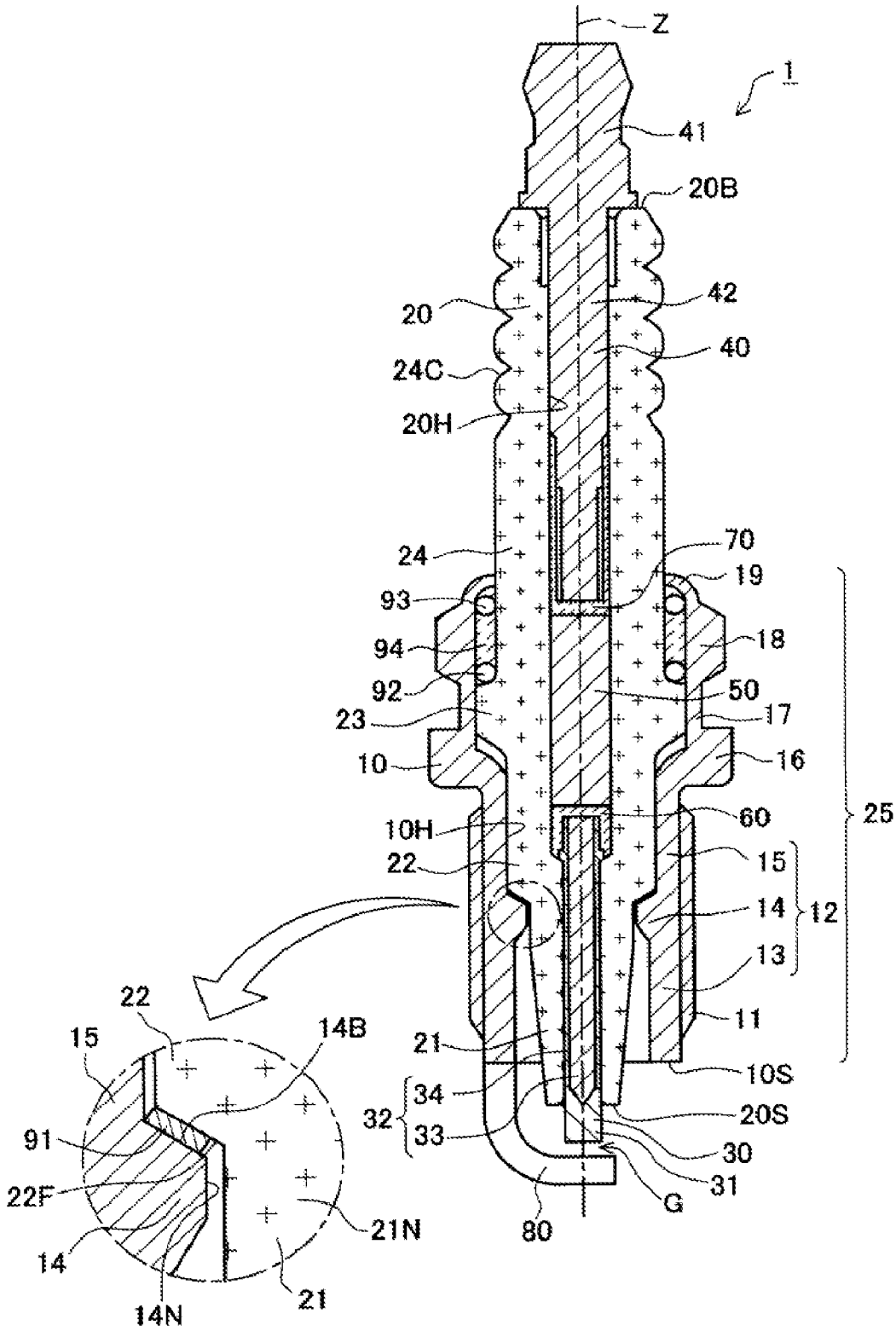
FIG. 1 is a longitudinal cross-sectional view showing the structure of a spark plug according to an embodiment.
Figure 2:
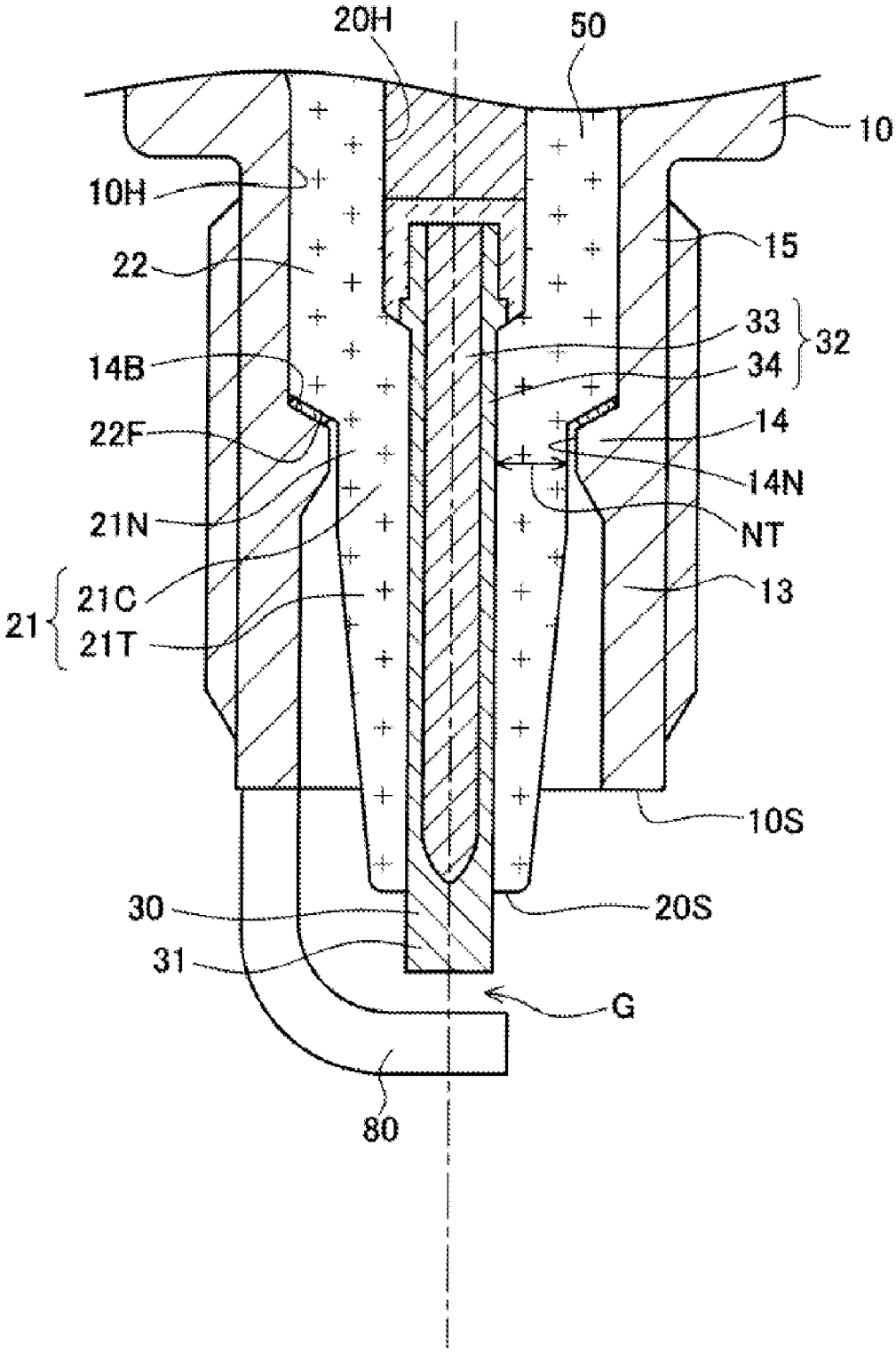
FIG. 2 is a partially-enlarged sectional view showing the front portion of a spark plug shown in FIG. 1.

FIGS. 1 and 2 show a spark plug 1 according to the embodiment of the present invention. FIG. 1 is a longitudinal cross section of the spark plug. FIG. 2 is a partially-enlarged sectional view of a front portion of the spark plug. In the embodiment of this specification, the direction along with an axis Z will be referred to as an axial direction (i.e., the top to bottom direction in FIGS. 1 and 2), and an end of the spark plug 1 to be inserted in an internal-combustion engine (not illustrated) (lower side in FIGS. 1 and 2) will be referred to as "front side", and the other end of the spark plug 1 to be located outside of the internal-combustion engine (upper side in FIGS. 1 and 2) will be referred to as "rear side".

The spark plug 1 is composed of a cylindrical metal shell 10 having an insulator holding hole 10H, an insulator 20 including an axial hole 20H therein, which extends in the axial direction, and engaging with the insulator holding hole 10H of the metal shell 10, a center electrode 30 held in the axial hole 20H of the insulator 20 and a terminal fitting 40 also held in the axial hole 20H.

One end of an outer electrode 80 is joined to a front end side 10S of the metal shell 10 by welding, and the other end thereof is bent in the lateral direction so that a side of the other end faces a front end portion 31 of the center electrode 30. As a consequence, a spark discharge gap G is formed between the outer electrode 80 and the center electrode 30.

The metal shell 10 is composed of a metal, such as low carbon steel, and shaped into a cylinder to serve as a housing of the spark plug 1. In the metal shell 10, a fixing screw 11 used for mounting the spark plug 1 to an engine block (not illustrated) is formed in an outer circumference face of a front portion 12, which is located in the front side. In the spark plug 1 according to this embodiment, the nominal designation of the fixing screw 11 is M12. The fixing screw 11 can also be the nominal designation of M10 which is smaller than M12. However, the nominal designation of the fixing screw 11 in this specification refers to the value specified in ISO 2705 (M12), ISO 2704 (M10) or the like, and naturally, the variation within the scope of the dimensional tolerance provided in these standards is permitted.

The metal shell 10 includes: a large diameter portion 16 having a larger diameter than that of the front portion 12 and projecting radially outwardly; an intermediate portion 17 having a diameter smaller than that of the large diameter portion 16; and a tool engagement portion 18, in the rearward (upper side in the drawing) of the front portion 12. The tool enagement portion 18 is used for engaging with a tool, such as a spanner and a wrench, when the spark plug 1 is mounted, and has a hexagonal pillar-like outer circumference. In the front portion 12, there is provided a middle cylinder portion 15 located rearward and connected to the large diameter portion 16, an engaging convex portion 14 projecting radially inwardly and located between the middle cylindrical portion 15 and a front cylindrical portion 13 including a top end face 10S.

The insulator 20 is composed of an alumina-system ceramic sintered body in which the axial hole 20H extending in the axial direction is formed therein. In the rear side of the axial hole 20H, a terminal portion 41 projects from a rear end face 20B of the insulator 20, and the terminal fitting 40 is fixed by a conductive glass seal 70 while a cylindrical axial portion 42 is held in the axial hole 20H. On the other hand, in the front side of the axial hole 20H, the center electrode 30 is fixed by a conductive glass seal 60 so that the front end portion 31 of the center electrode 30 projects from a front end 20S of the insulator 20. Further, in the axial hole 20H, a resistive element 50 is disposed between the axial portion 42 of the terminal fitting 40 and the center electrode 30.

Thus, the center electrode 30 and the terminal fitting 40 are electrically connected through the resistive element 50 and the conductive glass seals 60, 70. It is noted that the resistive element 50 is composed of a resistive composition made from mixed powder of glass powder and conductive material powder (when necessary, ceramic powder other than glass is added). The center electrode 30 includes the front end portion 31 projecting outwardly and a main portion 32 located at the rear side. The main portion 32 is composed of a core 33 made of Cu or a Cu alloy for facilitating the heat dissipation, and a cylindrical cover portion 34 surrounding the core 33. The front end portion 31 and the cover portion 34 are composed of a nickel alloy or the like having heat resistance.

In a center portion of the insulator 20 with respect to the axial direction, a flange 23 projecting radially outwardly is formed. Further, a middle trunk portion 22 having a smaller diameter than that of the flange 23 is formed at the front side (lower side in the drawing) of the flange 23. Furthermore, at the further front side of the middle trunk portion 22, a generally taper-shaped long leg portion 21 is formed. An engaging shoulder face 22F whose diameter is reduced like a step shape and facing the front at a slant is formed between the middle trunk portion 22 and the long leg portion 21. More particularly, the long leg portion 21 of the plug 1 according to this embodiment is composed of a cylindrical portion 21C located at the rear side and having a cylindrical outer circumference face; and a taper portion 21T located at the front side of the cylindrical portion (lower side in the drawing) and assuming a trapezoidal cone shape where the outer diameter tapers toward the front side. In the plug 1 according to this embodiment, as seen from FIG. 2, the boundary with respect to the axial direction between the cylindrical portion 21C and the taper portion 21T is located at the front side (lower side in the drawing) of the engaging convex portion 14 of the metal shell 10. Therefore, a portion in the long leg portion 21 facing the engaging convex portion 14 (i.e., an opposed portion 21N facing an inner circumference face 14N of the engaging convex portion 14) is located within the cylindrical portion 21C.

Further, a cylindrical main body 24 is formed at the rear side of the flange 23 of the insulator 20. A corrugation 24C is formed on the outer circumference face at the rear side of the main body 24. In the insulator 20, a front portion of the main body 24, the flange 23, the middle trunk portion 22 and the long leg portion 21 except for a front-end portion are an enclosed portion 25 surrounded by the metal shell 10.

The insulator 20 is inserted in the insulator holding hole 10H of the metal shell 10 from the rear side (upper side in the drawing). The engaging shoulder face 22F of the middle trunk portion 22 engages from the rear side (upper side in the drawing) with a rear engaging face 14B, which is located at the rear side of the engaging convex portion 14 of the metal shell 10 and faces the rear side at a slant, through a ring-shaped plate packing 91 so that the insulator 20 engages with the insulator holding hole 10H of the metal shell 10.

Further, in the metal shell 10, a ring-shaped line packing 92 which engages with the rear side of the flange 23 is arranged in a gap between an inner portion of the tool engagement portion 18 and an outer circumference face of the main body 24 of the insulator 20. At the further rear side of the ring-shaped line packing 92, another ring-shaped line packing 93 is arranged through a filling layer 94, such as talc. Then, the insulator 20 is pushed toward the front side (lower side in the drawing) of the metal shell 10, and a rear opening edge of the metal shell 10 is caulked toward the packing 93 to form a caulking portion 19. As a result, the insulator 20 is fixed to the metal shell 10.

It is noted that the axial hole 20H of the insulator 20 has a reduced diameter in the front portion thereof, which is inserted in the main portion 32 of the center electrode 30, and can be made to enlarge its radial size (thickness) in the long leg portion 21 of the insulator 20.

In the spark plug 1 according to this embodiment, in the long leg portion 21 of the insulator 20, a portion opposed to the engaging convex portion 14 of the metal shell 10 (i.e., the opposed portion 21N (cylindrical portion 21C) facing the inner circumference face 14N) with regard to the radial direction perpendicular to the axis Z (horizontal direction in the drawing), has a thickness NT of 1.80 mm or less, more particularly, as small as 1.77 mm.

It is noted that, in the plug 1 of this embodiment, the long leg portion 21 of the insulator 20 is formed by the cylindrical portion 21C and the taper portion 21T as mentioned above. Thus, the opposed portion 21N facing the inner circumference face 14N of the engaging convex portion 14 is included in the cylindrical portion 21C, and the thickness NT of the opposed portion 21N is equal to that of the cylindrical portion 21C. However, the size of the cylindrical portion 21C may be made small with regard to the axial direction, or the entire long leg portion 21 may be tapered toward the front side so as to be formed in a trapezoidal cone shape (i.e., the entire long leg portion 21 is made to be the taper portion 21T). In this case, the thickness NT of the opposed portion 21N facing the inner circumference face 14N changes with regard to the axial direction. Therefore, the representative thickness of the opposed portion 21N will be a thickness measured at the narrowest position in the opposed portion.

Beside the plug 1 according to this embodiment, spark plugs according to comparative forms 1 and 2 were used for measuring the withstand voltage of each plug. The plugs according to the comparative forms 1, 2 included the insulator 20 having a different texture from that of the embodiment (described later) but having the same dimension and the same form as that of the embodiment. In detail, the plugs according to this embodiment and the comparative forms 1, 2 were immersed into insulating oil, and the voltage of a spark discharge waveform was impressed between the metal shell 10 and the terminal fitting 40. In this case, since insulating oil was in the spark discharge gap G, no spark discharge was produced in the spark discharge gap G. While gradually increasing the maximum spark discharge waveform voltage, the spark discharge waveform voltage was repeatedly impressed. Then, the maximum value of the spark discharge waveform voltage was recorded as withstand voltage of the plug when a dielectric breakdown (penetration destruction) occurred in the insulator 20. Each form had 30 samples for the test.

TABLE 1

| Test samples | Alumina powder particle size (μm) | Defoaming step | Entire Pore rate (%) | 30 samples in each form Max. Pore area rate (%) *1 | Withstand voltage (kv) |
|---|---|---|---|---|---|
| Embodiment | 0.5 | yes | 4.5 | 22 | 36-42 |
| Comparative form 1 | 0.5 | no | 4.5 | 50 | 34-40 |
| Comparative form 2 | 1.5 | no | 4.5 | 47 | 34-40 |

*1: The Number of Measurement Views (The number of SEM photographs) 10

The result is shown in Table 1. As mentioned above, in the long leg portion 21 of the insulator 20, the thickness NT with respect to the radial direction of the opposed portion 21N facing the engaging convex portion 14N of the metal shell 10 was as small as 1.8 mm or less (1.77 mm). Thus, according to Table 1, the withstand voltage of the plug 1 according to this embodiment was 36-42 kV. That is, the plug 1 (the insulator 20) according to this embodiment could secure at least 36 kV of the withstand voltage. On the other hand, the withstand voltage of the comparative forms 1 and 2 having an insulator similar to that of the embodiment was 34-40 kV, repectively. That means the withstand voltage of only 34 kV was securable in the worst case.

The insulator 20 used for the plug 1 according to the embodiment has specific feature in its texture. More particularly, when a spark discharge waveform voltage is impressed to the terminal fitting 40 and the cross-section area of the enclosed portion 25 of the insulator 20 to which an electrical field is impressed in the thickness direction (the direction perpendicular to the axis: radial direction) is observed, specifically, the cross-section of the opposed portion 21N of the long leg portion 21 to which a high electrical field is easily impressed is observed, neither a giant pore having a large-cross section area nor an aggregate pore group is observed in the insulator 20 (refer to FIGS. 3-5).

Figure 3:
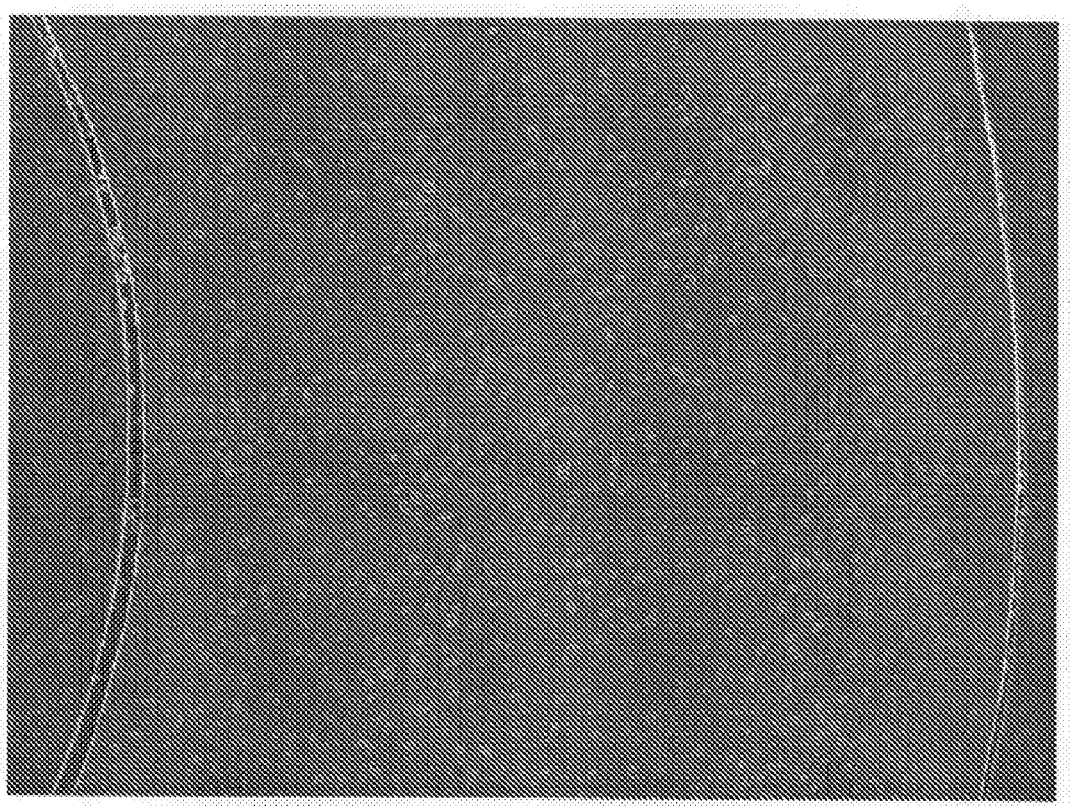
FIG. 3 is an SEM photograph showing an entire observation area (mirror-finishing section) of an insulator in a spark plug according to an embodiment.
Figure 4:
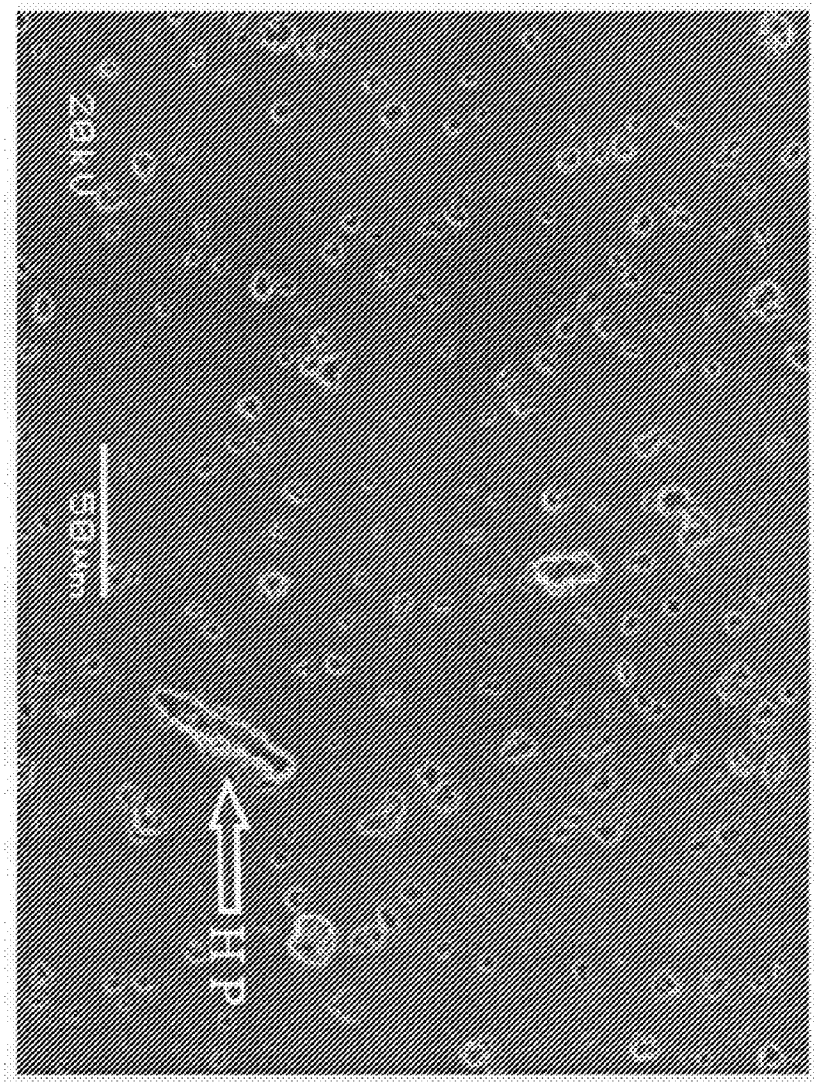
FIG. 4 is an SEM photograph showing a measurement view of an observation area of an insulator of a spark plug according to an embodiment.
Figure 5:
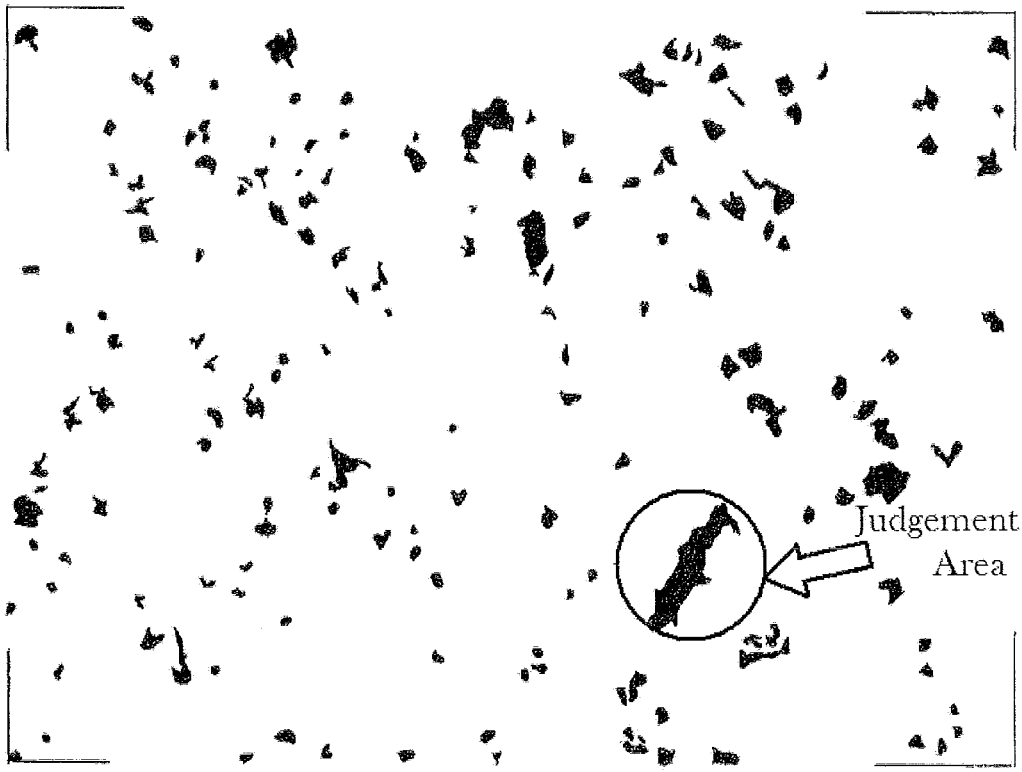
FIG. 5 is an explanatory view showing a condition where a ceramic surface and a pore portion present in the observation view of FIG. 4 are binarized.

Details will be described below. First, the plug 1 according to this embodiment was cut into a round slice (i.e., cut in the direction perpendicular to the axis Z) including the insulator 20 accommodated therein. The cross-sectioned insulator was embedded in a resin, and the mirror-finishing was performed to the cross section of a portion located in the enclosed portion 25, specifically, in the opposed portion 21N. Further, a carbon deposition was performed for applying electrical conduction to the ground surface, and the ground section was observed using an electron microscope. The electron beam used in the observation was set at an accelerating voltage of 20 kV and a spot size of 35-38 μm. FIG. 3 is an example of the SEM (scanning electron microscope) photograph showing an entire observation area (mirror-finishing section) of the insulator 20 in the plug 1 according to the embodiment. FIG. 4 is an SEM photograph showing a portion (a measurement view) in the observation area of the insulator 20 of the plug 1 according to the embodiment. The photograph shown in FIG. 4 is chosen as a photograph in which one of the largest pores in the plural observation views is shown. The size of the observation view shown in FIG. 4 is 355 μm×265 μm. FIG. 5 is an explanatory view showing a binarized condition where a ceramic surface (cross-section), which appears in the observation view shown in FIG. 4, is colored in white and a pore portion is colored in black.

The SEM photographs in FIGS. 3 and 4 show that the insulator 20 of the plug 1 according to this embodiment has a texture wherein isolated pores P having a diameter of about 10 μm or less are dispersed almost uniformly. The entire pore rate, which is a percentage of the pore portion present in the observation area (equal to the volume of the pore contained in the insulator), is 4.5% (refer to Table 1). However, as shown in the lower right portion of FIG. 4, a flat pore HP having a major axis of about 50 μm maximum may be present.

Figure 6:
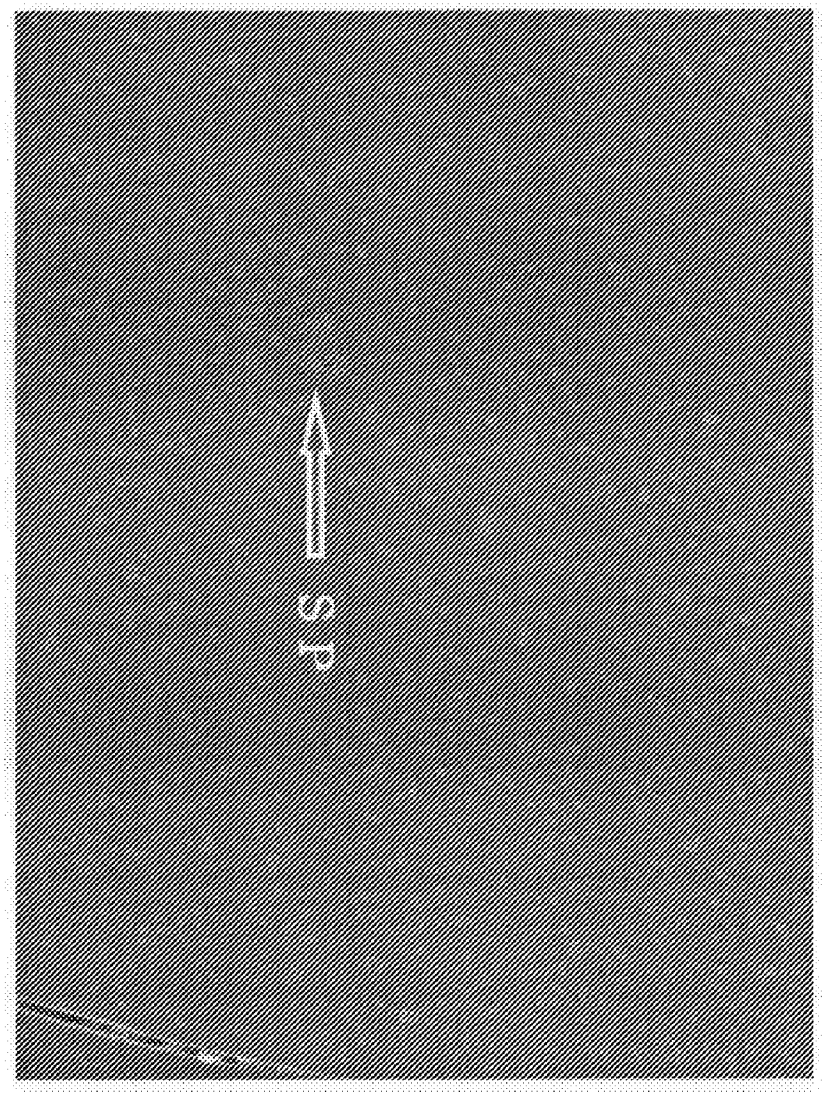
FIG. 6 is an example of SEM photograph showing an observation area (mirror-finishing section) of an insulator of a spark plug according to a comparative form 1.
Figure 7:
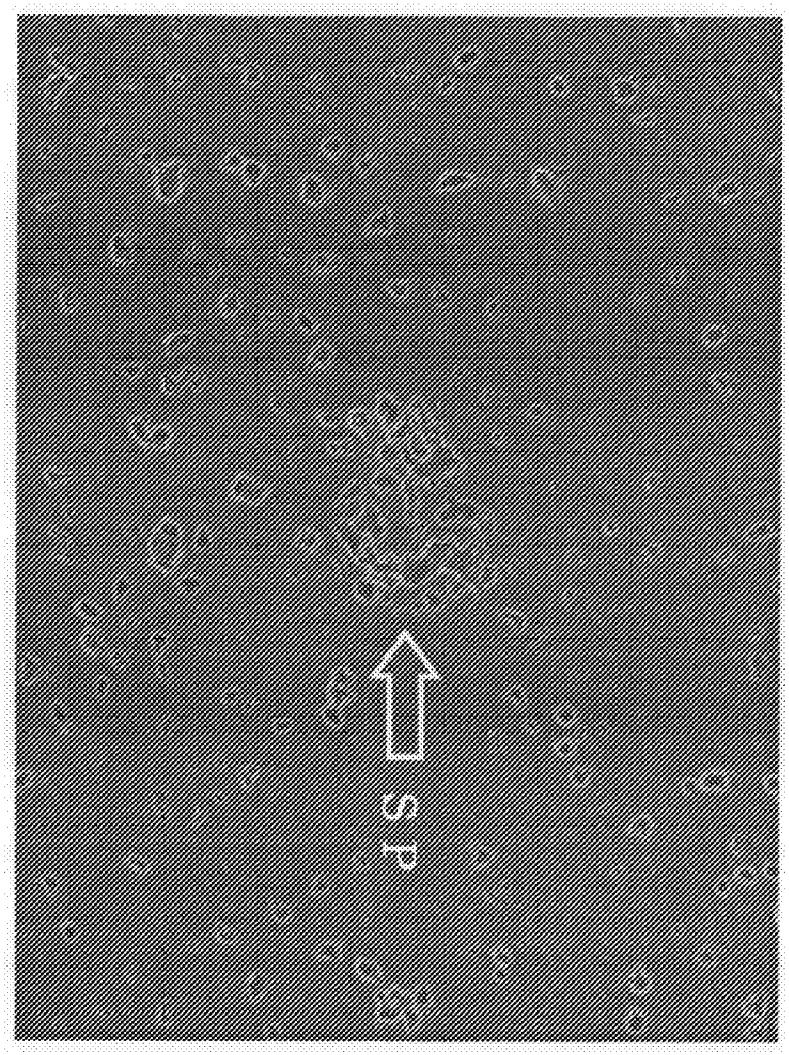
FIG. 7 is an SEM photograph showing a measurement view of an observation area of an insulator in a spark plug according to a comparative form 1.
Figure 8:
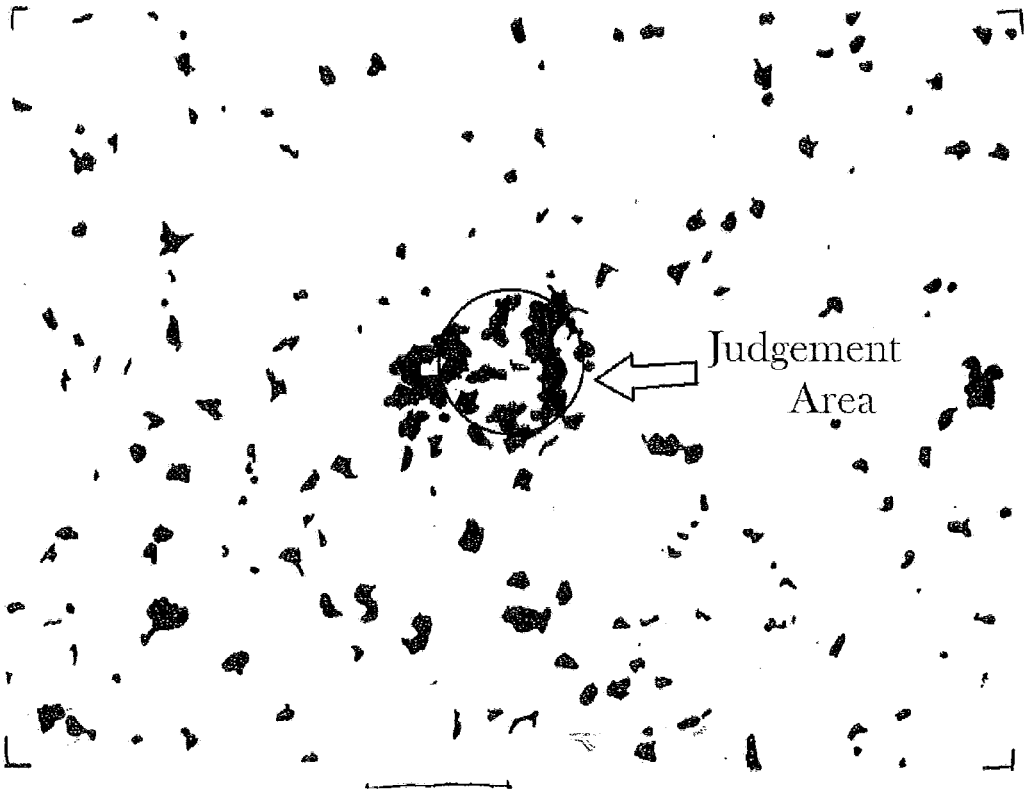
FIG. 8 is an explanatory view showing a condition where a ceramic surface and a pore portion present in the observation view of FIG. 7 are binarized.

On the other hand, the insulator used for the plug according to a comparative form 1 has a texture wherein the aggregate pore group SP is observed, when observing the observation area (refer to FIGS. 6-8). FIG. 6 is an example of SEM photograph showing the observation area of the insulator of the plug according to the comparative form 1. FIG. 7 is an example of SEM photograph showing a certain portion of the observation area. It is noted that FIG. 7 is also chosen as a photograph in which one of the largest aggregate pore groups SP is observed. Further, FIG. 8 is an explanatory view where the ceramic surface and the pore portion shown in FIG. 7 are binarized.

The SEM photographs shown in FIGS. 6 and 7 show that the insulator of the plug according to the comparative form 1 has also a texture wherein isolated pores P having a diameter of about 10 μm or less are dispersed almost uniformly. Similar to the embodiment, the entire pore rate is 4.5% (refer to Table 1). However, unlike the case of the above-described embodiment, as shown in the portion indicated by an arrow in FIG. 6 and in the center of FIG. 7, each pore is not so large, but the aggregate pore group SP in which a plurality of pores is concentrated is observed. The entire size of the aggregate pore group SP shown in FIG. 7 has a pseudo major axis of about 70 μm, which is substantially a large-scale pore group.

Figure 9:
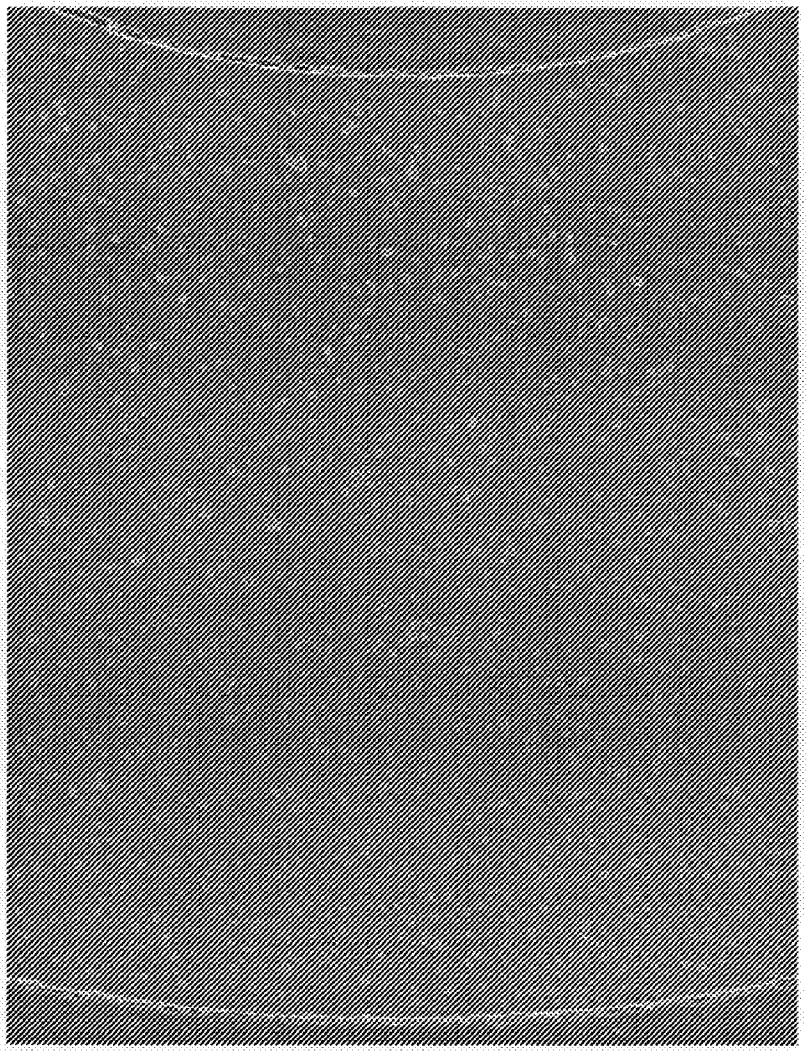
FIG. 9 is an example of SEM photograph showing an observation area (mirror-finishing section) of an insulator of a spark plug according to a comparative form 2.
Figure 10:
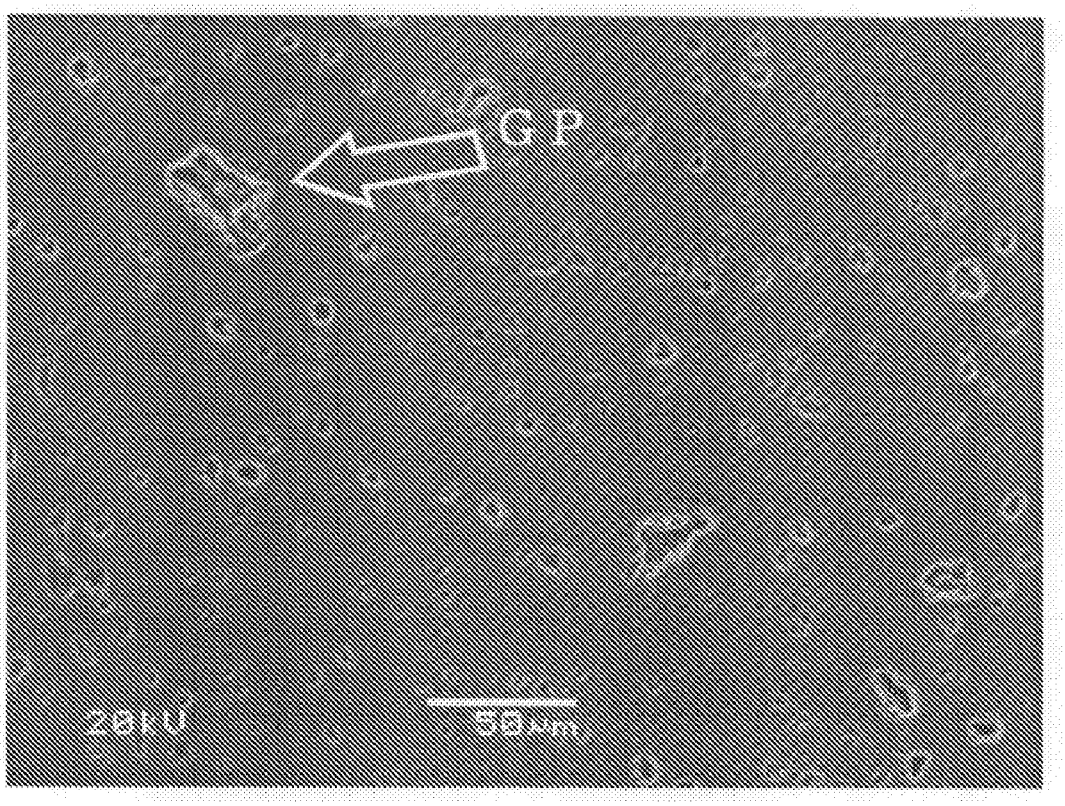
FIG. 10 is an SEM photograph showing a measurement view of an observation area of an insulator of a spark plug according to a comparative form 2.
Figure 11:
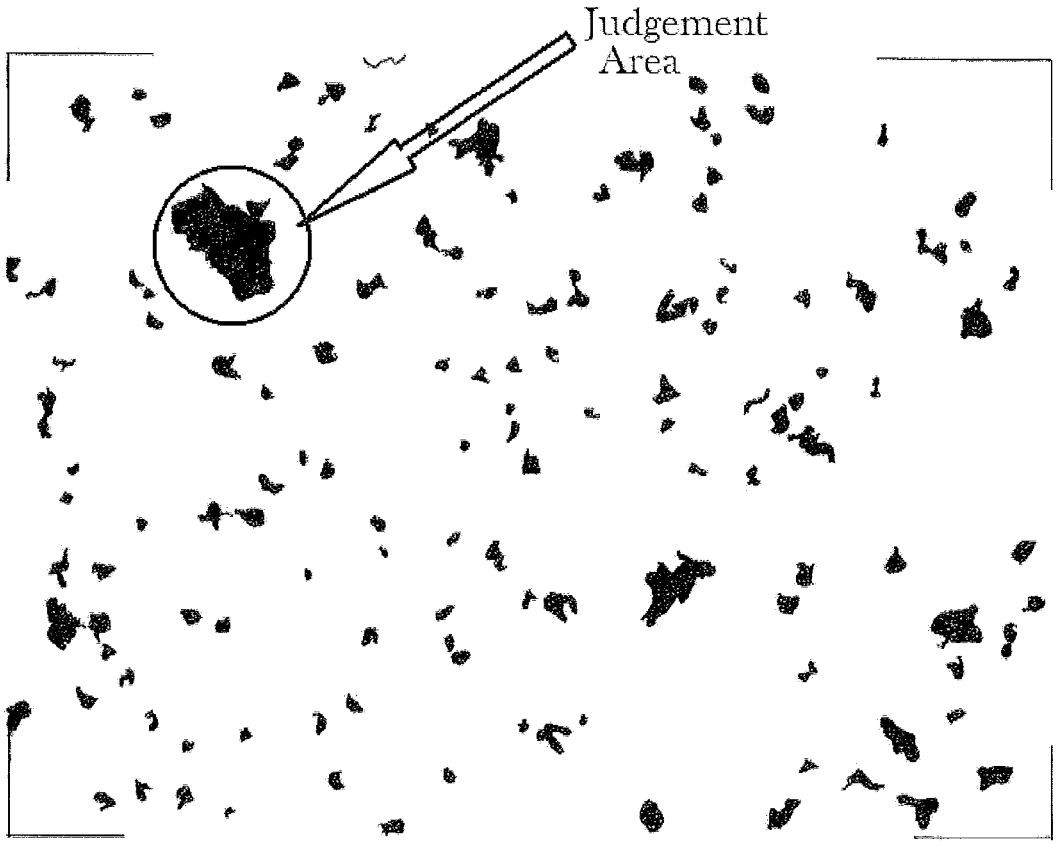
FIG. 11 is an explanatory view showing a condition where a ceramic surface and a pore portion present in the observation view of FIG. 10 are binarized.

The insulator used for a plug according to a comparative form 2 has a texture wherein a giant pore GP independently having a large cross-section area is observed in certain parts, when observing an observation area (refer to FIGS. 9-11). FIG. 9 is an example of SEM photograph showing the observation area of the insulator of the plug according to the comparative form 2. It is noted that FIG. 10 is also chosen as a photograph in which one of the largest giant pores GP is observed. Further, FIG. 11 is an explanatory view where the ceramic surface and the pore portion shown in FIG. 10 are binarized.

The SEM photographs in FIGS. 9 and 10 show that the insulator of the plug according to the comparative form 2 has also a texture wherein the isolated pores P having a diameter of about 10 μm or less are dispersed almost uniformly. Similar to the above embodiment, the entire pore rate is 4.5% (refer to Table 1). However, unlike the case of the above-described embodiment and the comparative form 1, as shown in the upper left portion in FIG. 10, the giant pore GP having not only a large major axis but also having a large cross-section area of the pore portion is likely to be observed.

Incidentally, when a certain defect exists in the texture of the insulator and a high electrical field is impressed to the insulator 20, a dielectric breakdown, which starts from such a defect, tends to be produced inside the insulator (i.e., penetration destruction). This dielectric breakdown causes a reduction in the withstand voltage of the plug and the insulator. In addition, since a plurality of small isolated pores P of about 10 μm in diameter are observed in the embodiment and the comparative forms 1, 2, these pores seem to have little influence on the withstand voltage of the plug. Further, since the size of the entire pore rate of the embodiment and the comparative forms 1 and 2 is almost the same size, the entire pore rate is unlikely to be a criterion for studying the relation among the properties of these 3 test samples. The reason for this is that there is a difference in the withstand voltage among these 3 test samples, even though these 3 test samples have the same entire pore rate.

On the other hand, when comparing FIGS. 4, 7 and 10 (also refer to FIGS. 5, 8 and 11), it is apparent that there is some relationship between the presence/absence and the size of a relatively large pore or a pore group formed in the insulator, and the magnitude of the withstand voltage. That is, the aggregate pore group SP (refer to FIGS. 7 and 8) similar to the comparative form 1 is not observed in the texture (refer to FIG. 4 and 5) of the insulator 20 according to the embodiment, which has a relatively high withstand voltage. Further, other than the ordinary observed isolated pore P with the diameter of about 10 μm, a large flat pore HP whose maximum diameter is 50 μm and assumes a flat shape may be observed. Thus, although the maximum diameter (major axis) of the flat pore HP is relatively large, the cross-section thereof is smaller compared to that of the giant pore GP (refer to FIGS. 10 and 11) observed in the comparative form 2.

Therefore, the presence/absence of the giant pore GP or the aggregate pore group SP in the insulator influences the magnitude of the withstand voltage of the plug (insulator). More particularly, this is considered based on the following reasons. Since there is a difference in the dielectric constant between a ceramic portion and a pore (air) portion, an electrical field concentrates on the pore portion. Particularly, in the giant pore GP with a large cross-section area, the magnitude of the electrical field concentration tends to be large, and an aerial discharge within the giant pore GP easily occurs. Thus, the giant pore GP is likely to serve as a starting point of the penetration destruction. When the aggregate pore group SP is observed, the reason for causing the penetration destruction is considered as follows. The ceramic portion present between the pores, which constitute the aggregate pore group SP, is thin. Therefore, when the aerial discharge occurs in a certain pore constituting the aggregate pore group SP, the thin ceramic portion present between the pores breaks whereby the pores are connected one after another. Similarly to the case where the giant pore is present, the aggregate pore group SP is likely to serve as a starting point of the penetration destruction.

Thus, a criterion used for distinguishing between the giant pore GP and the aggregate pore group SP which are observed in the comparative forms 1 and 2, and the flat pore HP observed in the embodiment will be examined. First, the aggregate pore group SP observed in the insulator (refer to FIGS. 7 and 8) according to the comparative form 1 will be discussed. Each pore constituting the aggregate pore group SP does not have a large cross-section area such as a giant pore GP observed in the comparative form 2. However, a plurality of pores is concentrated and it seems that the pores form a lump. There is also a portion in which the pores seem to be connected. Therefore, the diameter (major axis) of each pore is not suitable for using as a criterion for distinguishing between the aggregate pore group SP and the isolated pore P with the diameter of about 10 μm, many of which are observed in the insulator according to the comparative form 1. This is because a pore constituting the aggregate pore group SP and the isolated pore P not constituting the aggregate pore group SP cannot be distinguished based on only the size of the major axis of each pore.

First, using the photograph shown in FIG. 7, the ceramic surface and the pore portion observed in the observation view were binarized as shown in FIG. 8. In detail, the ceramic surface was colored in white, and a pore portion was colored in black. Then, assuming a hypothetical circle HC having a diameter of 50 μm, the hypothetical circle HC was located in a predetermined position in the observation view to calculate a percentage of the pore portion (a portion in black) included in the hypothetical circle HC. The hypothetical circle HC was repositioned repeatedly in the observation area to find out the maximum percentage (hereinafter referred to as a "maximum pore area rate").

More particularly, the hypothetical circle HC was located so that as many pores were included therein as possible, and the maximum pore area rate was calculated.

As shown in FIG. 8, by defining the maximum pore area rate in this way, the aggregate pore group SP was assuredly included in the hypothetical circle HC in the case where the aggregate pore group SP other than the isolated pore P was included in the observation view. The maximum pore area rate of each observation view (SEM photograph), which includes the aggregate pore group SP therein, was calculated, and the maximum rate in ten observation views was indicated in Table 1.

Similarly, the pore portion and the ceramic portion of the insulator according to the embodiment in FIG. 4 were binarized to obtain an explanatory view of FIG. 5. Further, the maximum pore area rate in FIG. 5 was calculated using the hypothetical circle HC.

Since the maximum pore area rate is defined as mentioned above, the flat pore HP is assuredly included in the hypothetical circle HC when the flat pore HP other than the isolated pore P is included in the observation view as shown in FIG. 5. The maximum pore area rate of each observation view (SEM photograph), which includes the flat pore HP therein, was calculated, and the maximum rate in ten observation views was indicated in Table 1.

Similarly, the pore portion and the ceramic portion of the insulator according to the comparative form 2 in FIG. 10 were binarized to obtain an explanatory view of FIG. 11. Further, the maximum pore area rate in FIG. 11 was calculated using the hypothetical circle HC.

Since the maximum pore area rate is defined as mentioned above, the giant pore GP is assuredly included in the hypothetical circle HC when the giant pore GP other than the isolated pore P is included in the observation view as shown in FIG. 11. The maximum pore area rate of each observation view (SEM photograph), which includes the giant pore GP therein, was calculated, and the maximum rate in ten observation views was indicated in Table 1.

According to Table 1, the maximum pore area rates of the plug (insulator) according to the embodiment and comparative forms 1, 2 were 22%, 50% and 47%, respectively. That is, in the insulator according to the embodiment, the maximum pore area rate was 22%, which was 40% or less. On the other hand, in the insulator according to comparative forms 1 and 2, the maximum pore area rates were 50% and 47%, respectively, both of which exceed 40%. As a result, it was found that the maximum pore area rate could be a criterion for a negative correlation with the withstand voltage of the plug. That is, when the maximum pore area rate is low, the withstand voltage of the plug tends to be high. Thus, it is preferable to employ the insulator having the maximum pore area rate of 40% or less, more preferably 30% or less.

Further, according to Table 1, as for two types of the insulators (comparative forms 1 and 2), each having a different type of the defect (i.e., the aggregate pore group SP and the giant pore GP), the withstand voltage was almost the same (34-40 kV). On the other hand, the maximum pore area rate of the insulators according to the comparative forms 1 and 2 was also almost the same percentage (50% and 47%). Thus, the maximum pore area rate can be a criterion used for different types of the defects (i.e., the aggregate pore group SP and the giant pore GP).

In the case where the maximum pore area rate is 40% or less when observing the pore in the observation area of the insulator (i.e., in the case where the area occupied by the pore in the hypothetical circle HC is 40% or less of a judgment area in the hypothetical circle HC), the plug (the insulator) is deemed to have high withstand voltage, compared to that of the comparative forms 1 and 2.

Figure 12:
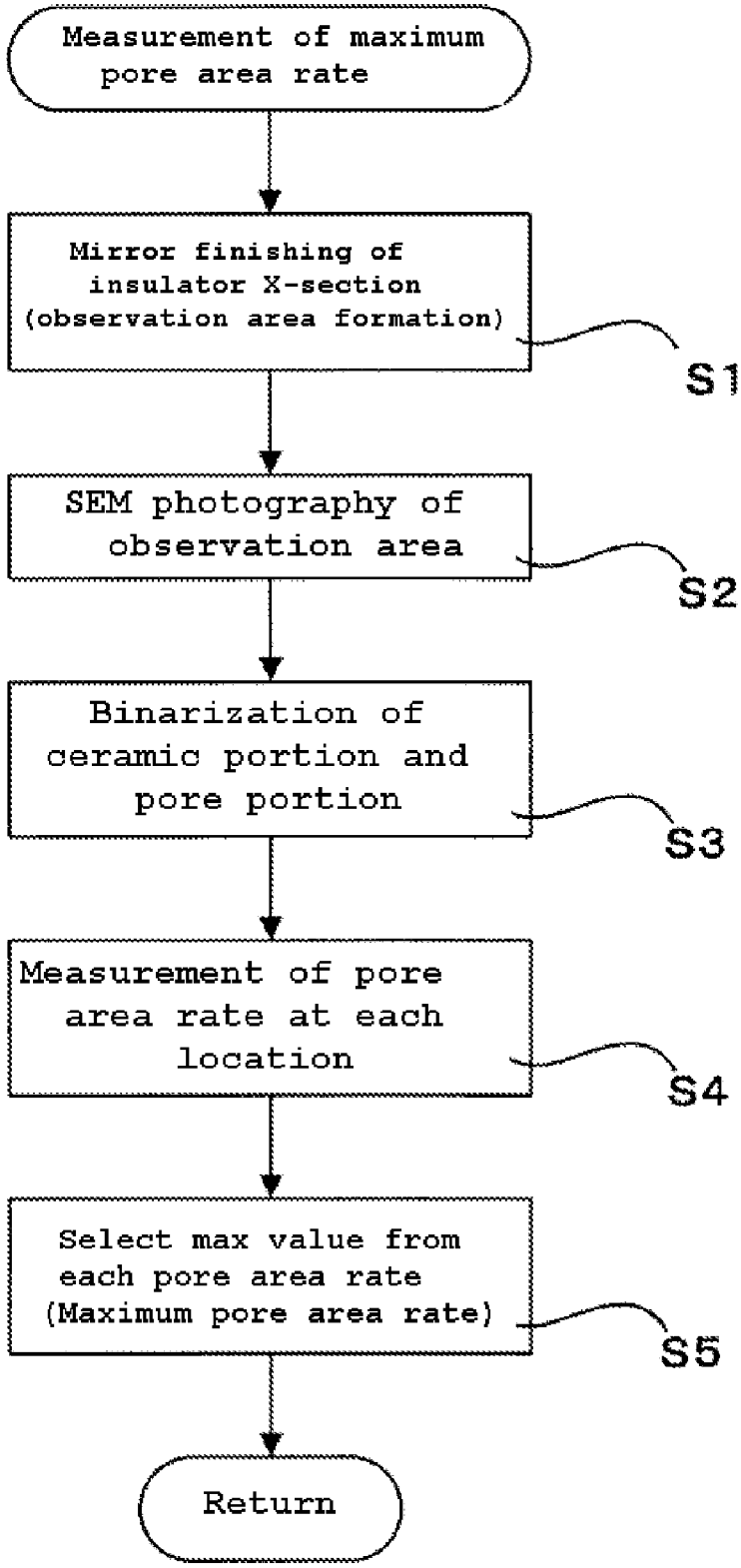
FIG. 12 is a flow chart showing a procedure for calculating a pore occupying area rate in a judgment area of an observation area.

A binarization in FIGS. 5, 8 and 11 and the calculation of the maximum pore area rate were performed as follows (refer to FIG. 12). As mentioned above, a cross section of the insulator is subjected to a mirror-finishing process so as to obtain an observation area (Step S1). While observing the observation area using an electron microscope, the SEM photographs of the observation view (355 μm×265 μm) containing the flat pore HP (the embodiment), the aggregate pore group SP (the comparative form 1) and the giant pore GP (the comparative form 2) are taken in A4 paper size (Step S2). The outline of the pore in an SEM photograph is traced on a tracing paper and the thus-traced pore portion is blackened. As a result, a picture having a pore portion in black and a ceramic portion in white is complete. Using a scanner (200 dpi), this image is captured and converted into a JPEG form. Luminosity (brightness) of each pixel is formed into 2 gradations using a predetermined threshold (e.g., threshold=209). That is, when luminosity of the pixel is below the threshold, it is converted to 0. On the other hand, when luminosity of the pixel exceeds the threshold, it is converted to 255 (72 pixels/inch). This means, there is no medium gradation. Accordingly, the binarization of each pixel is completed (Step S3).

The hypothetical circle HC having the diameter of 50 μm is located on the picture. The pixel located in the hypothetical circle HC is extracted to count the pixel contained in the hypothetical circle HC and the pixel deemed to be 0 luminosity. The pixel count deemed to be 0 luminosity is divided by the pixel count in the hypothetical circle HC, and the resulting value is a pore area rate in the hypothetical circle HC. Further, the hypothetical circle HC is relocated at predetermined positions to obtain the pore area rate of each position (Step S4). It is noted that the hypothetical circle HC is suitably located so that the area of the pore portion can be the largest in the hypothetical circle HC.

The largest pore area rate in the obtained pore area rates will be the maximum pore area rate in the observation view (SEM photograph) (Step S5). As mentioned above, the positions of the hypothetical circle HC where the maximum pore area rate is obtained are either the position where the hypothetical circle HC contains the flat pore HP in the case of the embodiment, the position where the hypothetical circle HC contains the aggregate pore group SP in the case of the comparative form 1, or the position where the hypothetical circle HC contains the giant pore GP in the case of the comparative form 2. Therefore, for example, in this embodiment, while relocating the hypothetical circle HC so that the flat pore HP is included therein, the pore area rate of each position in the hypothetical circle HC is calculated to obtain the maximum pore area rate. The same procedure may be applied to the comparative forms 1 and 2.

Figure 13:
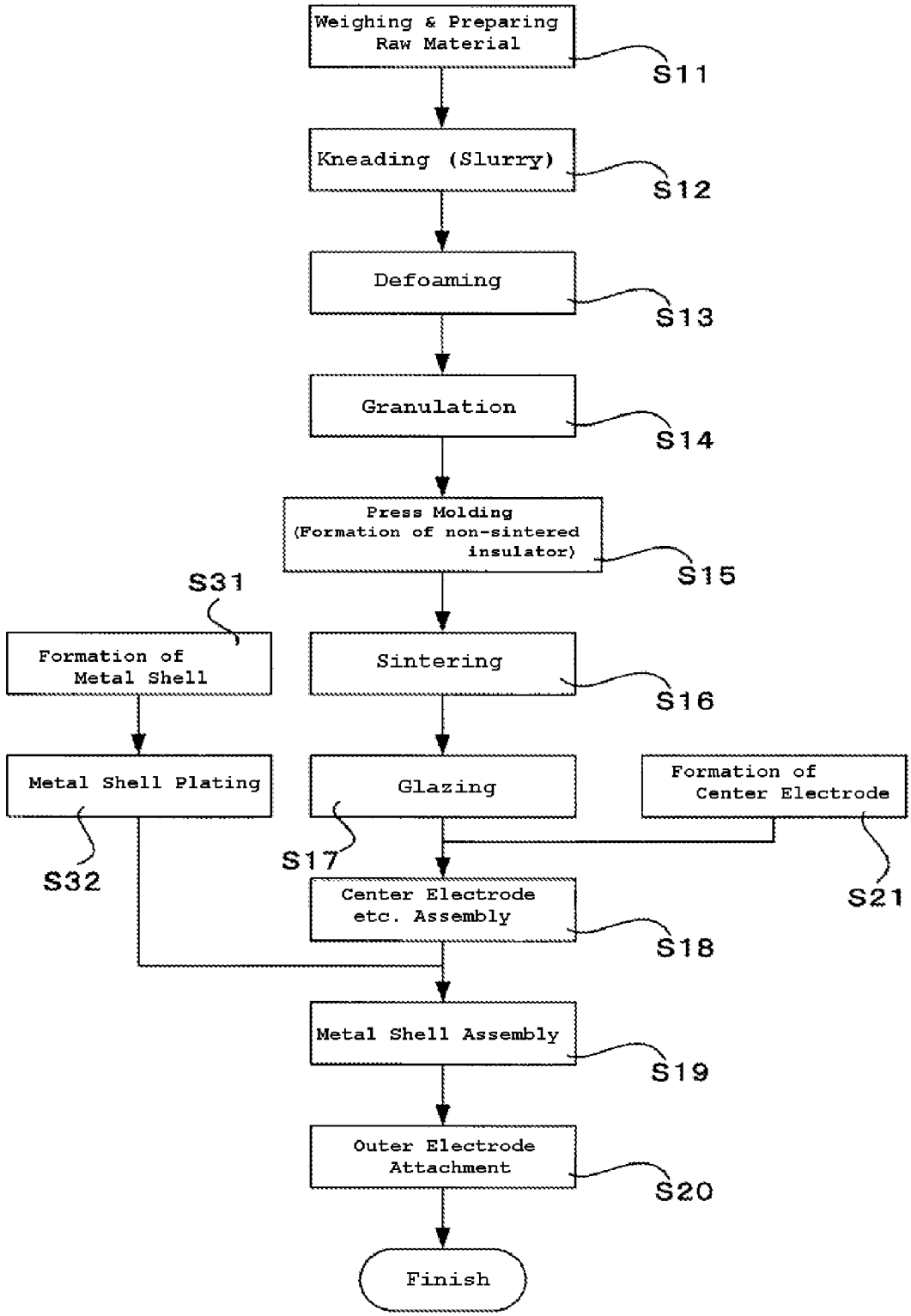
FIG. 13 is a flow chart showing manufacturing steps of an insulator in the manufacturing process of a spark plug according to an embodiment.

Next, a method for manufacturing the plug 1 according to this embodiment will be described with reference to FIG. 13. In the method for manufacturing the plug 1 according to this embodiment, only the method for manufacturing the insulator 20, more particularly, a method for manufacturing the powder used for a press molding of the insulator 20 differs from the spark plug of the comparative forms 1, 2 and the manufacturing method for other members is the same as those of the comparative forms 1, 2 and an ordinary plug. Therefore, mainly the different parts/portions from those in the comparative forms 1, 2 and an ordinary plug will be explained, and a detailed explanation regarding the same parts/portions will be omitted or simplified.

First, the method for manufacturing the insulator 20 according to this embodiment will be explained. In addition, the insulators according to the comparative forms 1, 2 will also be described regarding any different parts/portions from that of this embodiment.

According to this embodiment, as shown in Table 1, alumina ($Al_2O_3$) powder having a mean particle size of below 1.0 μm (in detail, 0.5 μm), which was smaller than that of the comparative form 2, was employed. Then, the alumina powder was weighed so as to be within 90-99.8% by mass, provided that a raw material powder was taken as 100% by mass.

Further, an additive element system powder which functioned as a sintering aid was mixed to prepare the raw material powder (Step S11). The raw material powder was prepared so that the composition of an insulator after sintering was to be Si: 2.0%, Ca: 2.0%, Mg: 0.1%, Ba: 0.4%, B: 0.5% and Al: 95.0% (unit: by mass).

In addition, the raw material powder was similarly prepared in the comparative form 1 using the same alumina powder and the additive element system powder. On the other hand, as shown in Table 1, the comparative form 2 used the alumina powder having a mean particle size of 1.5 μm, which was a relatively large particle size, to prepare the raw material powder in the similar manner.

It is noted that the additive element system powder is preferably composed of one or more types of components selected from Si, Ca, Mg, Ba and B. Provided that the raw material powder is taken as 100% by mass, the content of the additive element system powder composed of the above-mentioned component preferably falls within 4-7% by mass in total as reduced to oxides. As a result, the additive element system powder melts, and the liquid phase is easily produced at the time of the sintering. Thus, the additive element system powder can function as a sintering aid which facilitates an increase in density of the insulator. When the total content is less than 4% by mass, it is difficult to obtain the dense insulator, resulting in reducing the physical strength and the withstand voltage performance under the high temperature environment of about 700 degrees C. On the other hand, when the total content exceeds 7% by mass, the alumina content of the insulator obtained after sintering is not high enough, whereby the withstand voltage performance deteriorates.

More particularly, the additive element system powder can be composed of, for example, $SiO_2$ powder as an Si component, $CaCO_3$ powder as a Ca component, MgO powder as an Mg component, $BaCO_3$ powder as a Ba component and $H_3BO_3$ powder (or solution) as a B component. Thus, each component of Si, Ca, Mg and Ba used in the additive element system powder can be, in addition to use of the oxides of Si, Ca, Mg and Ba, various types of inorganic raw material powder, such as hydroxides, carbonates, chlorides, sulfates, nitrates and phosphates. However, these inorganic-based raw material powder have to be the powder which can be converted into oxides through sintering.

In this embodiment, in a slurry formation in Step S12, an organic binder and the water used as a solvent were mixed with the raw material powder by wet mixing to thereby prepare slurry. Here, the water-soluble acrylic resin was used as an organic binder. Further, provided that the raw material powder was taken as 100 parts by weight, the organic binder added was 2 parts by weight and a quantity of the water added was so prepared that the water content of thus-blended mixture composed of the raw material powder, the organic binder and water was 58%. The slurry in the comparative form 1 was formed in the same manner. Therefore, so far the same manufacturing manner is used for this embodiment and the comparative form 1.

On the other hand, in the comparative form 2, a different organic binder from that of the embodiment and the comparative form 1 was used, because the comparative form 2 used different type of alumina powder or the like. In the comparative form 2, a dispersant with a function which facilitates a defoaming of the slurry due to a surface-active effect was added to the slurry. The slurry was formed by wet mixing so that the alumina powder and a solvent (water) were blended smoothly.

However, the dispersant was not added to the slurry in the embodiment and comparative form 1. In the insulator after sintering, since carbon and the other remaining components generated by the dispersant might give an influence on an insulation performance (withstand voltage) of the insulator, no other additive was added except for the required organic binder.

The slurry according to the embodiment and the comparative form 1 used the alumina powder having a relatively small particle size. Therefore, the viscosity of the slurry becomes high compared to that of the comparative form 2, and the slurry easily encapsulates air bubbles therein. As a result, alumina powder tends to be condensed and form a void therein whereby the air bubbles are likely to be encapsulated in the slurry. Further, the air bubbles generated at a kneading step is unlikely to be released from the slurry. Thus, in this state, the air bubbles are likely to be encapsulated in spray granules mentioned later.

The slurry according to this embodiment was subjected to a defoaming step in Step S13. More specifically, a container in which the slurry after finishing the kneading step was disposed was located in a vacuum defoaming device to decompress. Then, the container is placed under the low pressure environment to thereby remove the air bubbles contained in the slurry, and thereafter, the decompression was released. As a result, the density of the slurry after the defoaming step rose by about 20%, compared to that before the defoaming step. Thus, the air bubbles equivalent to the above percentage contained in the slurry were thought to have been removed.

On the other hand, the slurry according to the comparative form 1 was not subjected to the defoaming step.

In addition, since the dispersant was contained in the slurry according to the comparative form 2 as mentioned above, the air bubbles were easily released in the kneading step. Thus, the defoaming step was not performed to the comparative form 2.

Subsequently, thus-prepared slurry was subjected to a granulation step in Step S14 to form spherical spray grains (granules), using a granulation device such as a spray drier. Thereafter, thus-formed granules were sieved and formed into a predetermined size to obtain spray granules.

In addition, when the spray granules were formed using the slurry according to the comparative form 1 to which no defoaming step had been performed, a portion of the spray granules contained a relatively large, amorphous and three-dimensional mesh structure-like void therein which is considered to have been caused by the air bubbles contained in the slurry. On the other hand, no spray granules containing such a large opening were found in the defoamed slurry according to this embodiment.

It is noted that the spray granules were also granulated from the slurry according to the comparative form 2 using a spray drier. The spray granules containing a large void therein were not found in the spray granules according to the comparative form 2. The possible reason for that is that the air bubbles in the slurry could be easily released due to the use of the dispersant.

Subsequently, in a press step in Step S15, the thus-formed spray granules were subjected to a rubber press molding. The outer circumference of the press-molded body was ground through use of a resinoid whetstone to form the predetermined outer shape. Then, non-sintered insulator corresponding to the predetermined shape of the insulator (refer to FIGS. 1 and 2) was completed. The same subsequent manner described below was applied to the comparative forms 1 and 2.

In this embodiment, although the press molding of the spray granules was performed through a rubber press molding, other molding method (e.g., extrusion molding) can be used to form a non-sintered insulator.

Further, the non-sintered insulator was retained and sintered at the temperature of 1500-1600 degrees C. under the atmosphere for 2 hours (Step S16). Thereafter, the thus-sintered body was coated with glaze and subjected to final firing, whereby the insulator 20 was completed (Step S17).

Apart from manufacturing of the insulator 20, the center electrode 30 composed of copper alloy which was surrounded and integrated with nickel alloy was formed by conventional known method in Step S21.

The center electrode 30 was assembled in the insulator 20 in Step S18. More specifically, the center electrode 30, the resistive element 50 and the axial portion 41 of the terminal fitting 40 were disposed in the axial hole 20H of the insulator 20. Then, these members were fixed together by heating and melting the conductive seal glass 60 and 70, to thereby secure the airtightness of the axial hole 20H.

On the other hand, apart from manufacturing of the insulator 20 and the center electrode 30, in Step S31, the metal shell 10 was formed by a conventional known method and also plated by a conventional known chromate plating in Step S32.

The insulator 20 in which the center electrode 30 was assembled was disposed in the insulator holding hole 10H of the metal shell 10, and the rear engaging face 14B of the engaging convex portion 14 and the engaging shoulder face 22F of the middle trunk 22 were engaged through the plate packing 91. Thereafter, the line packings 92, 93 and the filling layer 94 were disposed between the insulator 20 and the metal shell 10. Then, the caulking portion 19 was formed to thereby fix the insulator 20 in the metal shell 10 (Step S19).

Further, one end of the outer electrode 80 was welded to the front end side 10S of the metal shell 10. Furthermore, the other end of the outer electrode 80 was bent so as to face the front end portion 31 of the center electrode 30. Then, the plug 1 according to this embodiment and the plug of the comparative forms 1 and 2 were completed (Step S20).

As mentioned above, the plug according to the comparative form 1 was not subjected to the defoaming step (Step S13) in the manufacture of the insulator. Thus, as mentioned above, since the slurry employed in the comparative form 1 uses alumina powder having a relatively small particle size, the viscosity of the slurry becomes high, and the slurry tends to form a lump, compared to the slurry according to the comparative form 2. Therefore, alumina powder is likely to condense and form a void therein whereby the air bubbles tend to be encapsulated in the slurry. Also, the air bubbles produced in the kneading step are unlikely to be released from the slurry. For this reason, as mentioned above, a portion of the spray granules according to the comparative form 1 contains a relatively large, amorphous and three-dimensional mesh structure-like void therein which is considered to have been caused by the air bubbles contained in the slurry.

The insulator having a texture in which the aggregate pore group SP is included as shown in FIG. 7 is thought to be formed due to the use of such spray granules. That is, it is thought that the relatively large, amorphous and three-dimensional mesh structure-like void remained after the press molding of the non-sintered body, and also after sintering the insulator, and remained as the aggregate pore group SP.

On the other hand, as mentioned above, the plug 1 according to this embodiment was subjected to the defoaming step (Step S13) in the manufacture of the insulator 20. That is, although the plug 1 was manufactured by the same manner and the same materials (alumina powder etc.) as those of the comparative form 1, the texture of the insulator 20 according to this embodiment was considered to have no aggregate pore group SP because the defoaming step (Step S13) was added.

It is noted that the flat pore HP observed in the insulator 20 according to this embodiment is considered to involve a formation process different from that of the aggregate pore group SP. That is, when the rubber press molding is performed, the spray granules are crushed and the ceramic particles (alumina particles or additive element system powder) contained in the spray granules make contact with each other through an organic binder. However, the outer circumference face of the spray granules is not fully crushed in the press molding and assumes a husk-like form, which finally remains as the flat pore HP in the insulator 20.

The giant pore GP observed in the insulator according to the comparative form 2 is also considered to have a formation process different from that of the aggregate pore group SP. That is, when the rubber press molding is performed, a plurality of spray granules is compressed with each other, and finally each granule is crushed. However, the spray granules according to the comparative form 2 are unlikely to be crushed because the organic binders used in the embodiment or the comparative form 1 and the organic binder used in the comparative form 2 are different. Therefore, when the spray granules are crushed in the press molding, the spray granules are insufficiently crushed in a portion where the pressure is not easily applied, such as a position of the center of gravity of a regular tetrahedron when four spray granules are located at each peak of the regular tetrahedron, a large pore (giant pore GP) being thought to remain thereby.

It is apparent that a plug with a high withstand voltage can be materialized when the insulator 20 of the plug 1 adopts an insulator having a texture in which the maximum pore area rate is 40% or less. A concrete method for forming such an insulator is that the granulation is conducted after defoaming the slurry. More specifically, when any agent facilitating the release of air bubbles, such as a dispersant, is not added to the slurry and when alumina powder having an average particle size of 1.0 μm or less is employed, the granulation is preferably performed after defoaming the slurry.

Needless to say, the invention is not particularly limited to the embodiments described above but may be changed or modified in various ways within the scope of the invention and in accordance with the intended object and application.

In the spark plug 1 according to the above-mentioned embodiment, the fixing screw 11 formed in the metal shell 10 uses the nominal designation of M12. However, when the spark plug according to the present invention adopts a relatively slim spark plug including a fixing screw with the nominal designation smaller than M12 (e.g., M10), the present invention is specifically effective. For example, when a fixing screw has the nominal designation M10, the metal shell must secure enough thickness to maintain the physical strength required for each member. On the other hand, the diameter of the center electrode is 1.7 mm or more in the light of heat dispersion. When these are taken into consideration, in the long leg portion of the insulator, the radial thickness perpendicularly to the axis should be 1.6 mm or less in the portion facing the engaging convex portion of the metal shell. In the spark plug using the insulator with such thin thickness, the present invention specifically brings about an effect.

What is claimed is:

1. A spark plug used for an internal-combustion engine, comprising:

a cylindrical metal shell having an insulator holding hole;

a cylindrical insulator having an axial hole which extends in an axial direction, and said insulator having a region engaging with and surrounded by said insulator holding hole of said metal shell; and a center electrode held in said axial hole of said insulator;

wherein said insulator has a texture such that a measured area of one or more pores in any 50 μm diameter area of said insulator in the region surrounded by said metal shell, occupies 40% or less of such 50 μm diameter area, wherein the measurement is made by observing any cross sectioned, mirror-finished 50 μm diameter area in the region.

2. The spark plug used for an internal-combustion engine as claimed in claim 1 wherein, when an end of the spark plug to be inserted in an internal-combustion engine is referred to as "front side", and the other end of the spark plug to be located outside of the internal-combustion engine is referred to as "rear side" in said axial direction, said metal shell further comprises:

an engaging convex portion projecting radially inwardly including a rear engaging face, which is located at a rear side of said engaging convex portion; and a front cylindrical portion located at a front side of said engaging convex portion and having a larger inner diameter than that of said engaging convex portion; and said insulator further comprises:

a middle trunk portion including an engaging shoulder face located at a front side of said middle trunk portion and engaged with said rear engaging face of said metal shell from a rear side; and a long leg portion located at a front side of said middle trunk portion, having a smaller diameter than that of said middle trunk portion and forming a space with said front cylindrical portion of said metal shell; and in said insulator, a portion of said long leg portion facing said engaging convex portion of said metal shell has a thickness of 1.80 mm or less in a radial direction perpendicular to said axial direction.

* * * * *